US005649599A

United States Patent [19]

Catanese, Jr.

[11] Patent Number: 5,649,599

[45] Date of Patent: Jul. 22, 1997

[54] FAST ATTACK PENETRATING NOZZLE WHICH MINIMIZES POTENTIAL FORMATION OF BACKDRAFT CONDITIONS DURING FIRE SUPPRESSION

[75] Inventor: Anthony T. Catanese, Jr., Mamaroneck, N.Y.

[73] Assignee: The Catanese Family Limited Partnership, Mamaroneck, N.Y.

[21] Appl. No.: 562,112

[22] Filed: Nov. 22, 1995

[51] Int. Cl.[6] ..... A62C 31/22

[52] U.S. Cl. ..... 169/70; 239/271; 239/501

[58] Field of Search ..... 169/70; 239/271, 239/501

[56] References Cited

U.S. PATENT DOCUMENTS

| | | | |
|---|---|---|---|
| 674,343 | 5/1901 | Oakes | 239/271 |
| 2,055,590 | 9/1936 | Pugnet | 169/70 |
| 2,411,231 | 11/1946 | Rundle et al. | 239/271 |
| 2,621,076 | 12/1952 | Barton | 239/271 |
| 2,804,341 | 8/1957 | Bete | 239/501 |
| 3,135,330 | 6/1964 | Hanson et al. | 169/70 |
| 4,697,740 | 10/1987 | Ivy | 169/70 |
| 4,802,535 | 2/1989 | Bakke | 169/70 |
| 5,253,716 | 10/1993 | Mitchell | 169/70 |
| 5,368,106 | 11/1994 | Coughlin | 169/70 |

OTHER PUBLICATIONS

Bete; Nozzles for Bottle, Drum and Tank washing: Manual No. TW104.0 Bete Fog Nozzle, Inc. Greenfield, MA 01302-0311 USA (brochure believed to be published approximately 2 years ago).

*Primary Examiner*—Gary C. Hoge

*Attorney, Agent, or Firm*—Lackenbach Siegel Marzullo Aronson & Greenspan

[57] ABSTRACT

Penetrating nozzles are disclosed for first penetrating standard commercial and residential building materials to form a relatively small entrance hole or opening and subsequently delivering water to the area to cool off superheated gases. Different water dispersion attachments may be used, including a spiral or screw-type attachment for providing a mist or fog to the area or straight stream nozzles for directing a stream of water in directions either parallel to the axis of the nozzle or at an angle 90° thereto. The nozzles include a protector cap at the leading axial end thereof which is provided with a tip suitable for battering the surfaces or barrier and punch a hole through it. The protector tip is retained on the tubular attachment until the protector tip has penetrated the barrier and has been placed on the other side, at which time the application of water under pressure to the elongate dial causes the protector tip to be cast off or ejected. Preferably, a retaining member, such as a still cable, continues to secure the protector tip to the elongate barrel so that it may be retrieved through the opening in the barrier for re-use. The protector tip can be used to penetrate concrete block, brick and mild steel, and may be variably configurated to best penetrate these materials. Advantageously, a battering block is provided at the other axial end of the elongate barrel suitable for battering the device against the barrier by means of a sledge hammer, flat ax and the like.

18 Claims, 6 Drawing Sheets

FAST ATTACK PENETRATING NOZZLE WHICH MINIMIZES POTENTIAL FORMATION OF BACKDRAFT CONDITIONS DURING FIRE SUPPRESSION

BACKGROUND OF THE INVENTION

1. Field of the Invention

This invention generally relates to fire equipment apparatus and, more specifically, to a nozzle for rapidly penetrating a fire barrier and delivering water to an area containing superheated gases while minimizing fire backdraft.

2. Background of the Invention

To the fire fighting community, the threat of a potential backdraft condition is of prime concern. More firefighters and civilians are injured or killed each year by the super heated gases and toxins created by the products of combustion, than the fire itself.

Backdrafts are formed when a fire, in an enclosed area, uses most of the available oxygen during its free burning stage. The fire, as this available oxygen is used up, actually darkens down or diminishes in intensity. The smoke and gases that are direct products of combustion rise to the highest levels of the room where they are superheated by the flames. This oxygen poor, superheated gas forces other combustible items in the enclosed area to degas (porassify). This degassing of combustibles increase the toxicity and energy level in this superheated oxygen poor environment. If oxygen is introduced into this atmosphere by current standard fire fighting methods a backdraft erupts with explosive force.

When a door or window is either opened or broken, large quantities of oxygen are sucked into the superheated gaseous environment. When this mixture reaches the explosive range, a flash fire erupts instantly igniting the burning gases outward and setting fire to any combustibles in its path including humans. Since the primary indication of a potentially lethal condition is the sucking inward of immense volumes of air, the word backdraft was coined.

For years, the fire service has known the best way to combat a potential backdraft condition is to either vent the superheated gases at the highest point when possible, or use copious quantities of fog spray to form steam. The injection of a fine fog spray into a superheated environment instantly changes the water droplets to steam. This changing of water to steam increase the volume injected to 27 times its original size. This phenomenon also absorbs vast amounts of energy and in doing so lowers the temperature of the gasses and the room to below its flash point.

The steam vapor also traps the toxic contaminants and they condense and fall to the floor as a sooty slurry. There is a serious flaw in this steam injection method, however, that until now has been unsolved. Currently, to enter this superheated environment in order to inject steam, fire fighters have to risk their lives by opening a door or window enough to direct a fog nozzle into the area of conflagration. Of course oxygen is also let in, and the backdraft scenario is set. The ideal method would be to inject water fog without letting any, or a minimal amount of oxygen into the room.

SUMMARY OF THE INVENTION

Accordingly, it is an object of the present invention to provide a nozzle for combating fires which does not have the disadvantages inherent in prior nozzles.

It is another object of the present invention to provide a nozzle for penetrating barriers which is effective in preventing or minimizing formation of backdraft conditions during fire suppression.

It is still another object of the present invention to provide a penetrating nozzle of the type in the previous objects which is simple in construction and economical to manufacture.

It is yet another object of the present invention to provide a nozzle which can be easily battered, manually or by the use tools, against a barrier to be penetrated.

It is a further object of the present invention to provide a penetrating nozzle of the type under discussion which is easy and convenient to use, and can be quickly and efficiently implemented in the field.

It is still a further object of the present invention to provide a penetrating nozzle for rapidly providing a relatively small entrance opening in a barrier made of variant materials, including wood, metal, concrete block, brick or mild steel and the like.

It is an additional object of the present invention to provide a nozzle of the type indicated in the previous objects which can be used both to initially penetrate standard commercial and residential building materials and subsequently provide a fog spray in an area of superheated gases to cool the gases off and prevent or minimize backdraft.

It is still an additional object of the present invention to provide a penetrating nozzle which can deliver large quantities of super fine fog, straight stream or 90° angled stream rendering the nozzle a versatile fast attack nozzle useful in many fire fighting situations.

It is yet an additional object of the present invention to provide a penetrating nozzle as in the previous objects which can readily be battered against a barrier during fire fighting with appliances readily available to fire fighters, including sledge hammers or flat head axes.

It is also an object of the present invention to provide a nozzle as in the previous objects which is effective for backdraft suppression while automatically converting itself from a battering implement to a spray or fog dispensing device upon the application of water under pressure by a fire fighter after the nozzle has penetrated through a barrier into an area of superheated gases.

In order to achieve the above objects as well as others which will become apparent hereinafter, the present invention is for a backdraft suppression penetrating nozzle for rapidly providing a relatively small entrance opening in a barrier between an enclosed first area containing superheated gases and a second area which is devoid of superheated gases for introduction of water into the first enclosed area. The barrier defines a plane and has a predetermined thickness along a direction generally normal to the plane of the barrier. The penetrating nozzle comprises an elongate barrel defining an axis and having a generally uniform cross section substantially corresponding to the size and shape of the small entrance opening in the barrier to provide little clearance between said elongate barrel and the barrier for passage of gases therebetween when said elongate barrel is received within the entrance opening. At least a portion of said elongate barrel is hollow and forms an elongate passageway having an opening at one axial end of said elongate barrel. Water inlet means communicates with said passageway for delivering water under pressure into said passageway. A cup shaped protector tip having a cavity shaped and dimentioned to releasably receive said one axial end of said elongate barrel and having a barrier piercing point directed along said axis and formed of a material suitable for piercing the barrier once said elongate barrel is battered against the barrier along an axial direction which is substantially normal to the point of the barrier. Said penetrating tip is separable from said axial end of said elongate barrel once said protector tip has formed an entry hole or opening in the barrier and has penetrated to the other side of the barrier and water under pressure is supplied to said passageway to overcome retaining forces which retain said protector tip on said one axial end.

The nozzle of the present invention is capable of being punched through barriers of all standard commercial and residential building materials to reach areas of enclosed superheated gases. In this way, only the barrel and the nozzle are initially introduced into a potentially dangerous overheated area. When water is turned on, the protector tip on the nozzle is blown off or ejected by hydraulic pressure. This allows the nozzle to introduce water into the area in a form most useful to combat the fire. Thus, depending on the specific nozzle used, the nozzle can form a large cone of fire fog spray, convert the spray to steam and reduce the probability of formation of a backdraft. Once the room is sufficiently cooled, safe entry can be made and the remaining fire put out safely. The nozzle can then be pulled out of its entry hole, the protector tip replaced back over the nozzle and re-used again at another location.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which.

DESCRIPTION OF THE PREFERRED EMBODIMENTS

Figure 1:
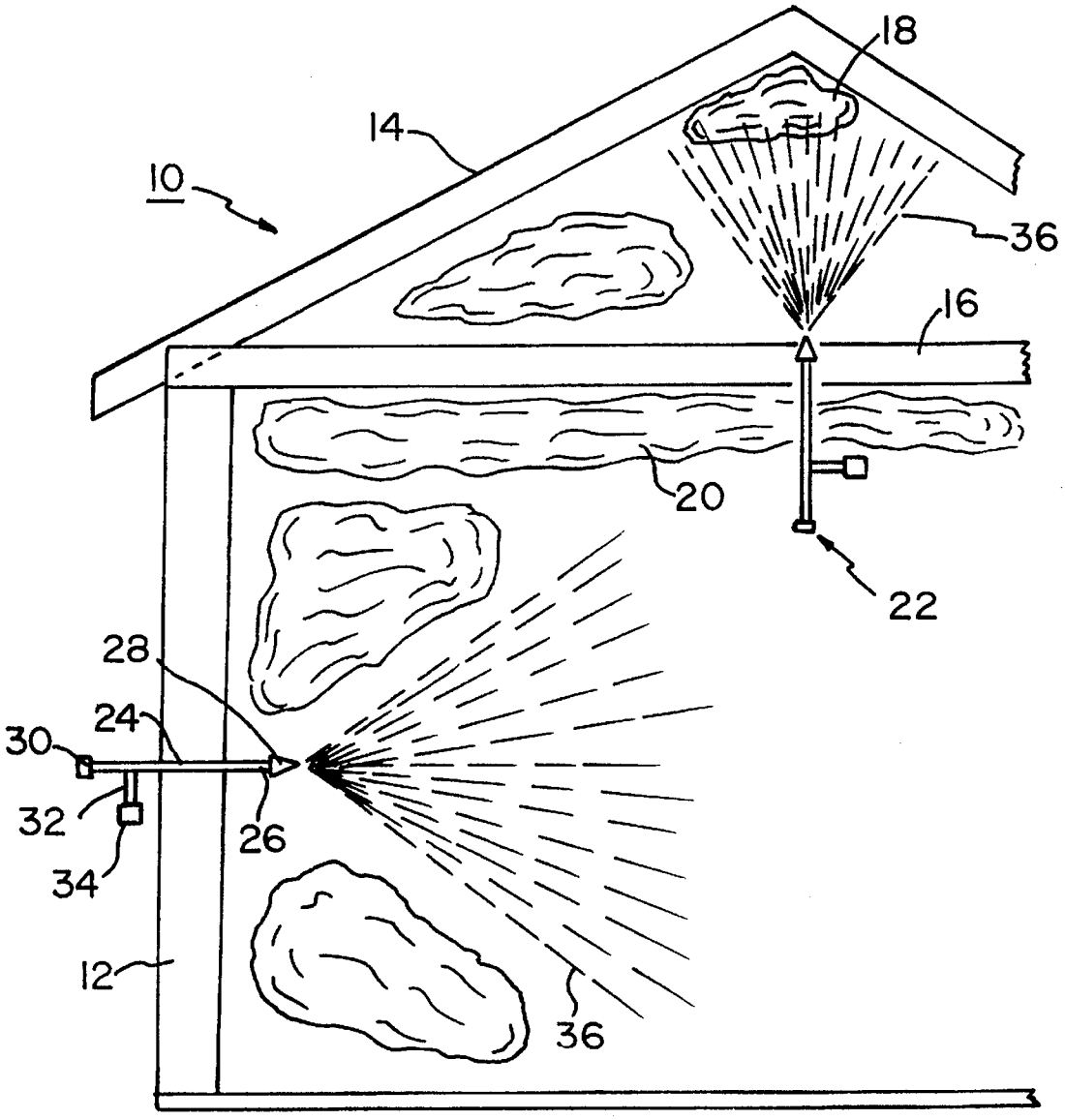
FIG. 1 is a diagrammatic representation of a building structure and potential barriers which seal off areas in which superheated gases may have developed, and the manner in which the penetrating nozzle of the present invention can be used to rapidly access those areas and cool down the superheated gases while minimizing the potential for backdrafts.

Referring now specifically to the figures, in which identical or similar parts are designated by the same reference numerals throughout, and first referring to FIG. 1, the reference numeral 10 generally designates a building structure which may develop areas of superheated gases during a conflagration.

The structure 10 is intended to represent a conventional building or house having vertical walls 12 and a roof 14, shown as a pitched roof. An attic floor 16 is also illustrated. Because heat rises, a region 18 illustrates a point where an accumulation of superheated gases typically occurs. When the attic is sealed from the remainder of the house or building and the fire occurs at a lower level, heated gases can also accumulate below the attic floor 16, such as in the region 20. Superheated gases can, in fact, accumulate in any closed-off or sealed region of the building where a fire takes place when the gases have no room to escape or rise as suggested. A penetrating nozzle in accordance with the present invention is generally designated by the reference numeral 22 and it has as its primary function to penetrate through a barrier, such as a wall, floor or ceiling, to allow introduction of water or water spray into an enclosed area containing the superheated gases from an area beyond or outside of the barrier into which the firefighters have gained access which is devoid of superheated gases. As will be more fully described below, the use of the penetrating nozzle 22 of the present invention first entails the rapid penetration through the relevant barrier or barriers within the structure and, subsequently, the introduction of water in some form to cool the superheated gases. The penetrating nozzle 22 includes an elongate barrel 24 which has a forward penetrating portion 26 which is provided with a penetrating or piercing tip 28 which is made of a material and shaped to be capable of being punched through standard commercial and residential building materials, such as wood frame, concrete block, brick or mild steel, or a plurality of these.

The elongate barrel 24 defines an axis and has a generally uniform cross section substantially corresponding to the size and shape of a small entrance opening in the barrier to be formed, in order to provide little clearance between the elongate barrel and the barrier for passage of gases once the barrier has been penetrated as suggested in FIG. 1. While the penetrating or piercing tip 28 is disposed at the leading or forward end portion 26 of the barrel 24, the other or rear axial end of the barrel 24 is advantageously provided with a hammering block 30 which permits the penetrating nozzle to be driven by any appropriate tool, such as a sledge hammer or flat head ax to batter the barrier B until the piecing tip 28 has penetrated through the barrier.

A water inlet or conduit pipe 32 is provided which communicates with a passageway within the barrel 24 for delivering water under pressure into the passageway. The conduit or pipe 32 is connected to a standard hose by means of hose fittings 34.

As will be noted from FIG. 1, the penetrating nozzle 22 can be battered against a vertical wall 12 to essentially create a substantially horizontal entrance opening or bore in the wall, or battered in a vertical direction through a floor or ceiling to create a substantially vertical entrance opening or bore.

Once the penetrating nozzle has, in fact, penetrated through the respective barrier, wall or ceiling, water under pressure is applied to the passageway within the barrel 24 and, as will be more fully described hereinafter, water is released within the area containing the superheated gases. In FIG. 1, such water is released by dispersing the same either as a fine fog spray in any suitable pattern, such as a conical pattern as shown, or as a straight or focused stream, as will be more fully discussed below.

Figures 2, 3:
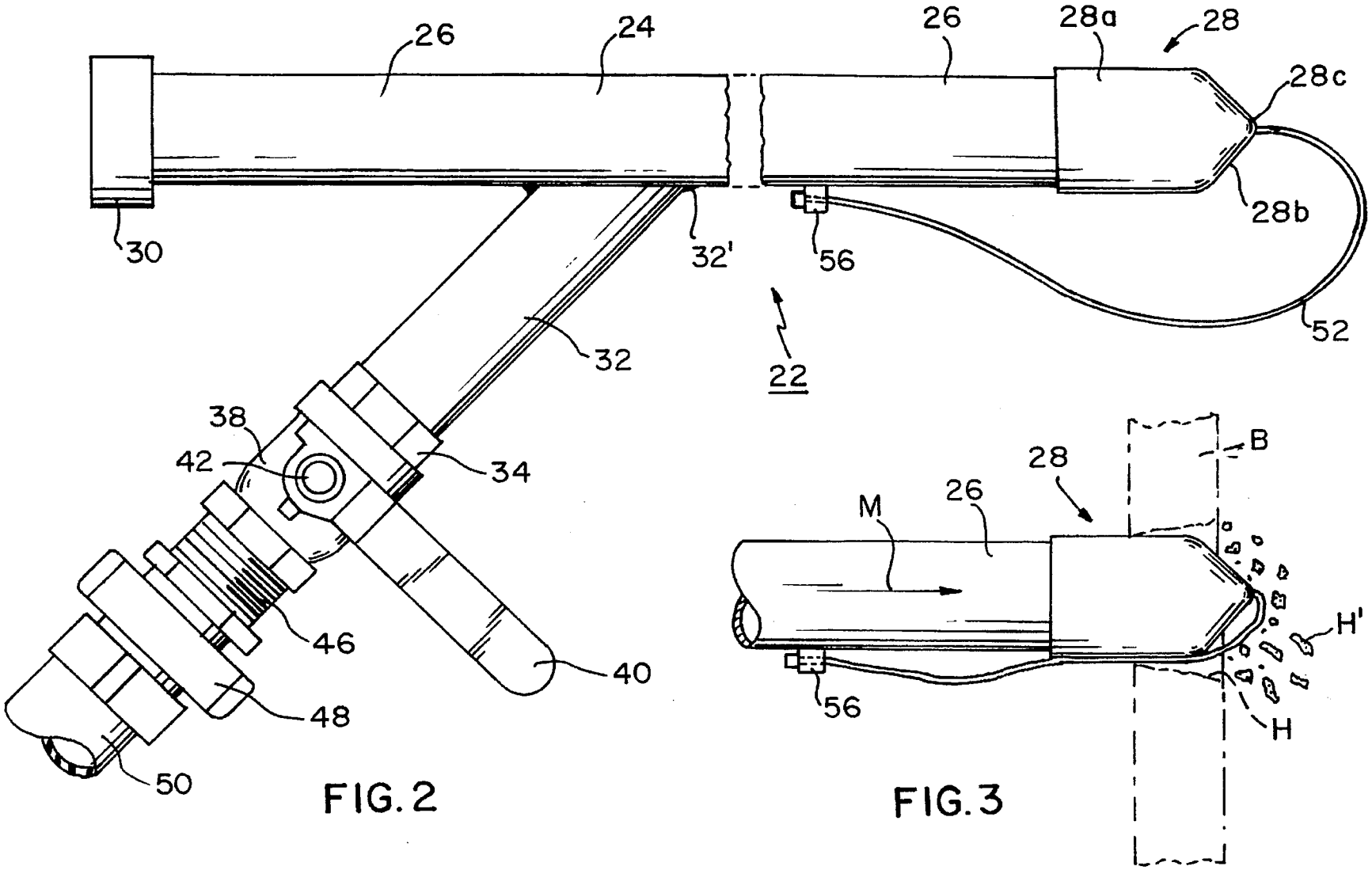
FIG. 2 is a side elevational view of a penetrating nozzle in accordance with the present invention, shown with the protector tip mounted on the barrel and connected to a water delivery hose ready to be used for penetrating a barrier to reach an area of trapped superheated gases.
FIG. 3 is a fragmented side elevational view showing the forward part of the nozzle shown in FIG. 2, and shown, in phantom outline, how the protector tip is used to penetrate a barrier and form an entry hole or opening therein.
Figure 5:
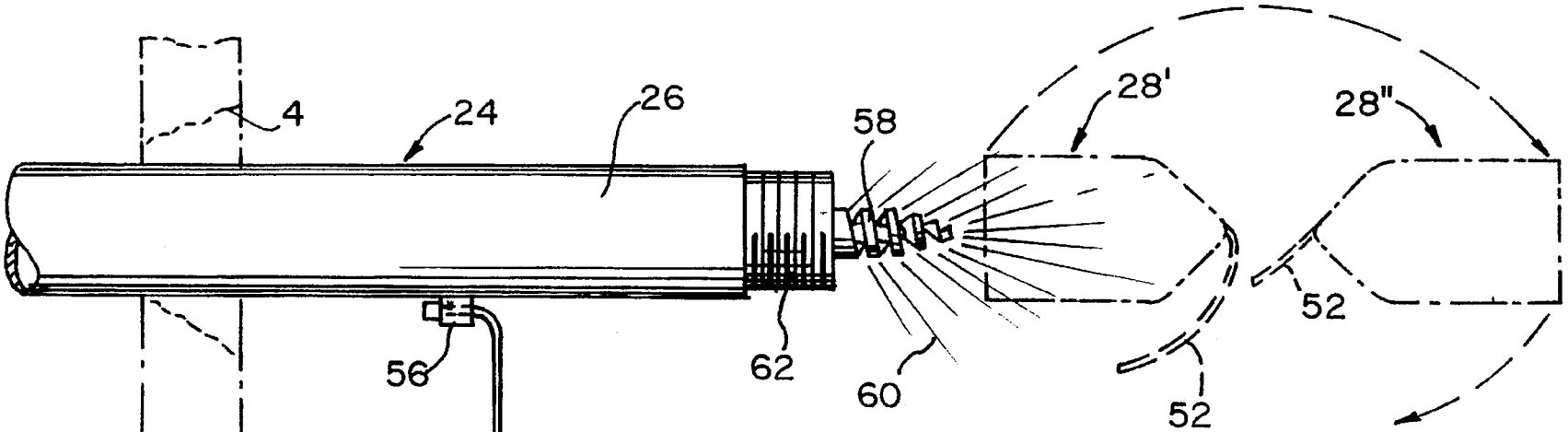
FIG. 5 is similar to FIG. 4, but showing how the retaining cable is used to recover the protector tip through the entry hole or opening for use at another location.
Figure 5:
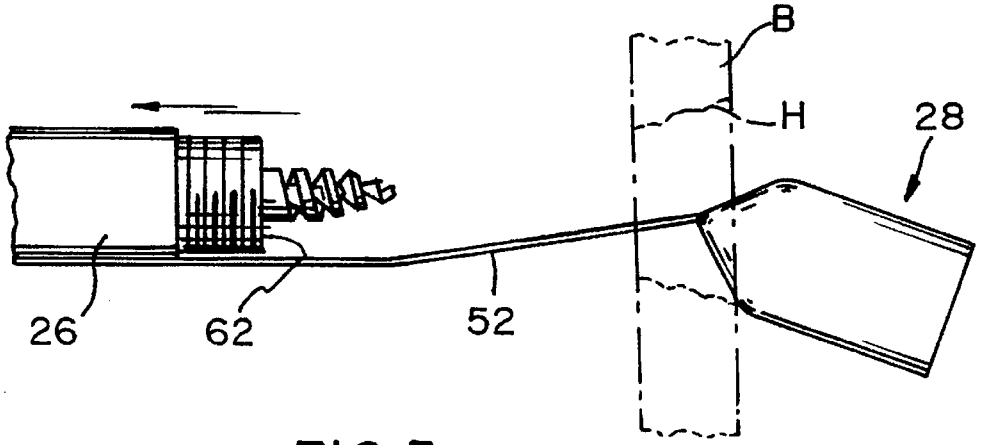

Referring to FIG. 2, the details of the penetrating nozzle 22 are more fully illustrated. The elongate barrel 24 has a general uniform cross section substantially corresponding to the size and shape of a small entrance opening in the barrier in order to provide little clearance between the elongate barrel 24 and the barrier itself, as suggested, for passage of gases therethrough when the elongate barrel is received within the entrance opening. The forward, axial end, penetrating or leading portion 26 of the penetration nozzle may, but need not, be internally or externally threaded, for reasons discussed hereinafter. Additionally, the leading portion 26 of the barrel 24 is hollow and forms an elongate passageway having an opening (FIG. 4) of the elongate barrel through which water may be released. The water inlet, conduit or pipe 32 may be attached to the barrel 24 in any conventional manner, such as a weld 32'. The conduit or pipe 32 is preferably joined to the barrel 24 at an angle or incline as shown in FIG. 2, urging the water entering into the barrel passageway generally towards the forward end of the barrel 24 through which the water is emitted. The manner in which the water conduit or pipe 32 is connected to the fire fighting equipment is not critical and any suitable means may be used. Thus, for example, the conduit or pipe 32 may be provided with a fitting 34 which connects to a suitable valve 38 having a control handle or lever 40 preferably mounted on a pin 42. The valve 38 may be joined, by means of a threaded nipple 46 and a fitting 48, to a fire hose 50. With the valve lever or handle 40 in the position shown, the valve 38 would normally be closed thereby preventing water from entering into the barrel 24. However, when the lever or handle 40 is rotated 90° the valve 38 is opened and water, at full pressure, is permitted to enter into the barrel 24 and be emitted at the open end of the barrel.

An important feature of the present invention is the use of a protector tip 28 which has a cylindrical sleeve portion 28a, which is dimensioned to provide an internal cavity shaped and dimensioned to receive the axial end 26 of the penetrating nozzle, and a generally conical portion **28*b*, which forms a barrier piercing point 28*c* directed along the axis and formed of a material suitable for piercing standard barriers when the elongate barrel 24** is battered against the barrier along an axial direction substantially normal to the plane of the barrier. As will be discussed below, the protector tip can take on various shapes, sizes and can be made of different materials to accommodate different barrier types and materials.

The protector tip 28 is preferably retained on the nozzle portion 26 in a manner to be readily separable from the axial end of the barrel once the protector tip has formed an entry hole or opening in the barrier and has penetrated to the other side of the barrier and water under pressure is supplied to the passageway to overcome any retaining forces which retain the protector tip on the barrel. One way of retaining the protector tip on the barrel 24 is suitably the use of a friction fit which can be readily overcome by the significant forces generated by the water pressure once the water valve 30 has been opened. Before the water is applied, the protector tip 28 is frictionally secured to and maintained on the penetrating nozzle portion 26 as the penetrating nozzle is battered though a wall.

A useful, and optional feature illustrated in FIG. 2 is the use of a cable 52 which connects to the barrel 24. The cable 52, which is preferably a steel cable, can be attached to the protector tip 28 in any suitable fashion, preferably close to the piercing point **28*c*. A cable retainer 56 may be provided on the surface of the barrel 24 which retains the cable at the other end. The purpose of the cable 52 will now be more fully described in connection with FIGS. 3 and 4**.

Figure 4:
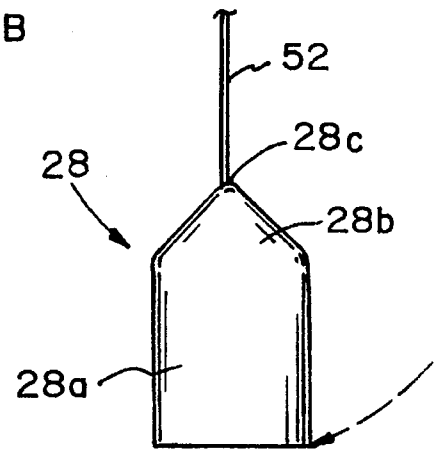
FIG. 4 is a fragmented side elevational view similar to FIG. 3, but showing the leading part of the nozzle after it has penetrated the barrier and water has been applied to the nozzle to eject or cast off the protector tip to expose a spray forming attachment in the path of the water stream.

In FIG. 3, the forward, battering motions or movements of the penetrating nozzle are represented by the arrow M. The protector tip 28 is shown to be in the process of completing an entry hole or opening H in the barrier B by displacing shattered pieces of debris H'. In FIG. 4, once the forward portion 26 of the barrel 24 has penetrated through the opening H and the water valve 38 has been turned on, the protector tip 28 is cast off, by the hydraulic pressure, and initially assumes the position 28'. When it is time to retrieve the protector tip 28 the barrel 24 is withdrawn from the hole or opening H and the cable 52, which is attached to the barrel 24, is simultaneously retrieved, this essentially rotating the orientation of the protector tip by 180° to a position 28", orienting the piercing point **28*c* in the direction of the hole or opening H. This makes it easier to re-introduce the protector tip 28** into the hole or opening H for the purpose of retrieving the same for later re-use. Without such re-orientation, it would be very difficult if not impossible to withdraw the protector tip through the barrier, particularly when there is little or no clearance between the inside of the hole or opening H and the external surface of the protector tip.

Figure 8:
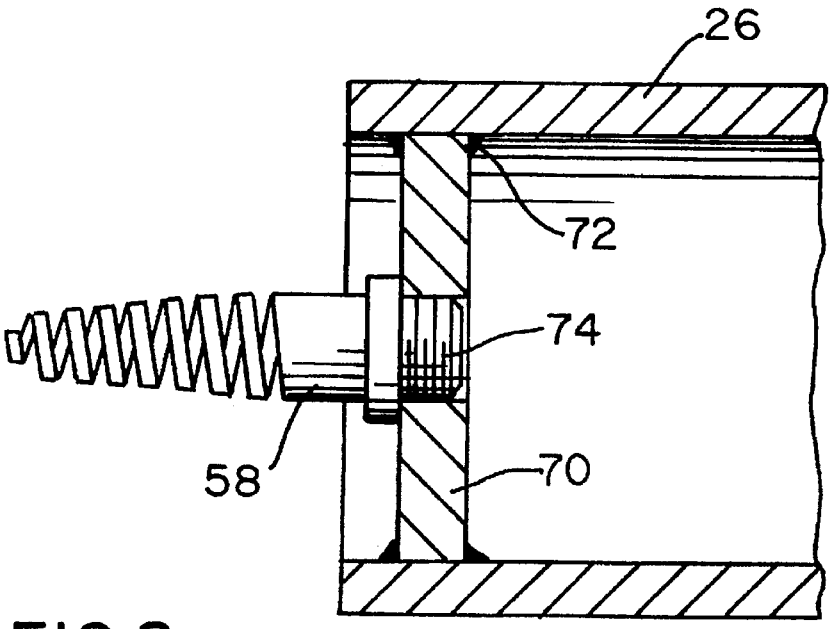
FIG. 8 is a longitudinal cross sectional view of the leading end of the elongated barrel shown in FIG. 4, showing one manner of securing the spiral or screw spray nozzle attachment to the elongate barrel in the path of water flow.
Figure 9:
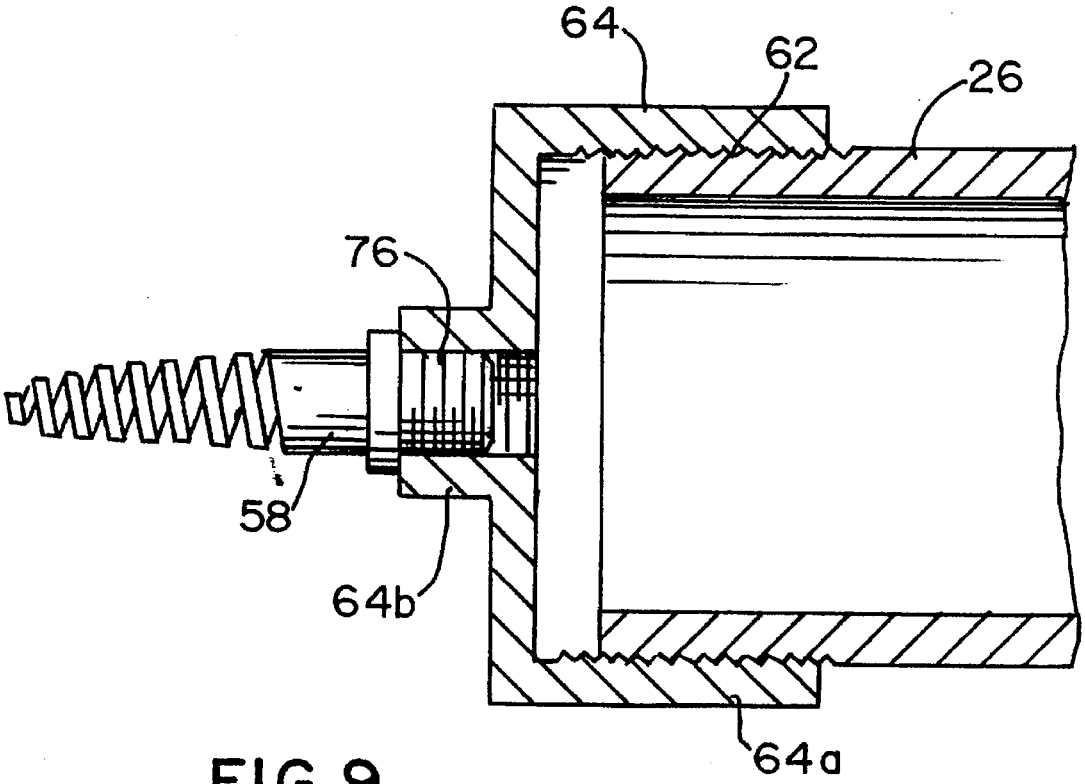
FIG. 9 is similar to FIG. 8, but showing an alternate embodiment for mounting the attachment by use of an internally threaded step-down coupling.

In accordance with one feature of the invention, suitable water dispersing means is provided at the axial end of the barrel 24 which is normally covered by the protector tip 28. Referring, for example, to FIG. 4, such dispersing means is illustrated for dispersing water exiting from the opening at the axial end after water under pressure has been introduced into the passageway of the elongate barrel 24 and the protector tip has been ejected or cast off as described. The specific dispersing means used is not critical for the purposes of the present invention, and a variety of such means may be useful in connection with different types of fire fighting situations. In FIG. 4, one such means, in the form of a spiral or a screw attachment spray nozzle 58 is illustrated for dispersing the water along a conical trajectory 60 of the type illustrated in FIG. 1. As indicated, different water dispersing devices may be used. By way of example, only, reference is made to nozzles sold by BETE Fog Nozzle, Inc., of Greenfield, Mass., such as the PW line of nozzles which provide 180° and 270° spray angles. Other spray nozzles are also disclosed in manual No. TW104.0 published by BETE Fog Nozzle, Inc. In order to secure these water dispersing devices to the barrel 24, different approaches may be used. Referring to FIG. 8, for example, there is illustrated a retaining or supporting plate 70 which is arranged in a plane substantially normal to the axis of the barrel 24 and is welded to the internal surface thereof at 72. The retainer plate 70 is provided with a central internal threaded hole 74 to receive the externally threaded base or shank of the screw attachment 58. A variant attachment method for this version of spray element 58 is illustrated in FIG. 9, in which a stepped fitting 64 has a larger diameter portion 64*a* internally threaded to engage external threads 62 on the portion 26 of the barrel, a smaller diameter portion 64*b* being internally threaded to receive external threads on the base or shank of the dispersion or sprayer element 58. The bases or stems of the spiral or screw spray attachments have central bores through which the water under pressure can pass to impinge upon the spiral or auger-like fin or surface to disperse the water into a spray or fog as aforementioned.

Figure 6:
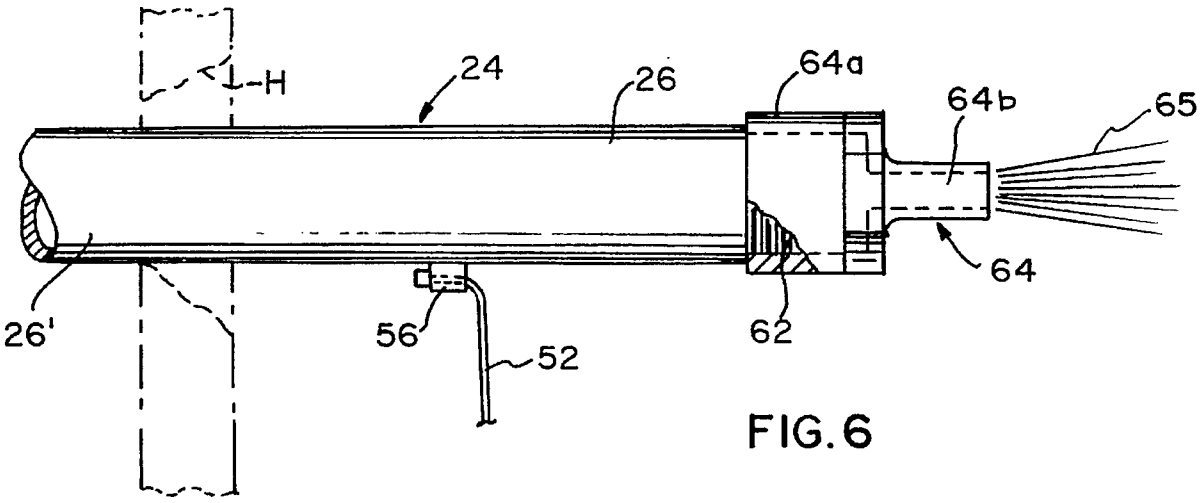
FIG. 6 is similar to FIG. 5, but showing a nozzle attachment which provides a straight stream of water instead of a spray or fog.
Figure 7:
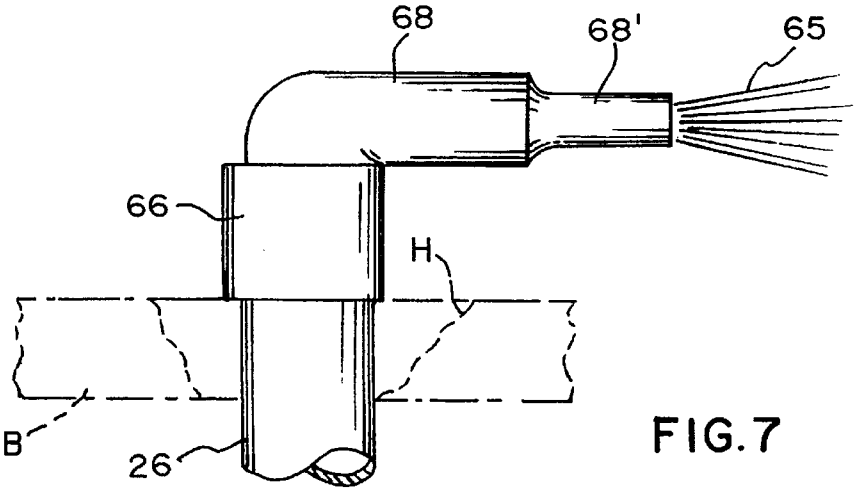
FIG. 7 is similar to FIG. 6, but showing a right angle nozzle attachment for directing the water stream in a direction substantially parallel to the plane of the barrier and perpendicular to the axial direction of the elongate barrel forming the nozzle.

In FIG. 6, the screw-on fitting 64 is mounted by means of the cylindrical internally threaded portion 64*a*, a small diameter nozzle 64*b* having a reduced area compared to the area of the exit opening on the barrel 24 in order to provide an inline stream of water 65. In FIG. 6, the reduced area nozzle 64 opens in a direction substantially parallel to the axis of the elongate barrel. In FIG. 7, on the other hand, a similar structure is shown in which the nozzle opens in a direction at an angle substantially 90° to the axis of the elongate barrel. In this way, fire fighters have a number of options with which to combat the fire and reach areas within the structure which need initial attention. As shown therein, threaded portion 66, is secured to the leading portion 26, and it is suitably provided with an elbow pipe 68 having a reduced area nozzle 68' for providing a stream of water 65' generally parallel to the penetrated wall surfaces, in contrast to that of FIG. 6 which water flow is generally transverse to the wall surfaces.

Figure 10:
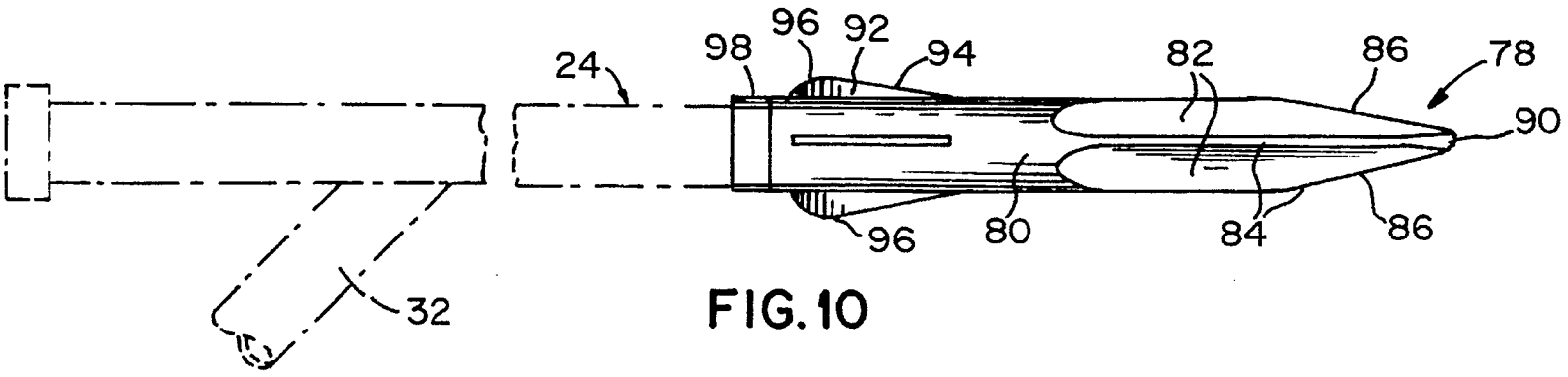
FIG. 10 is similar to FIG. 2, but illustrating a protector tip which is more particularly adapted for penetrating concrete block and brick barriers.
Figure 11:
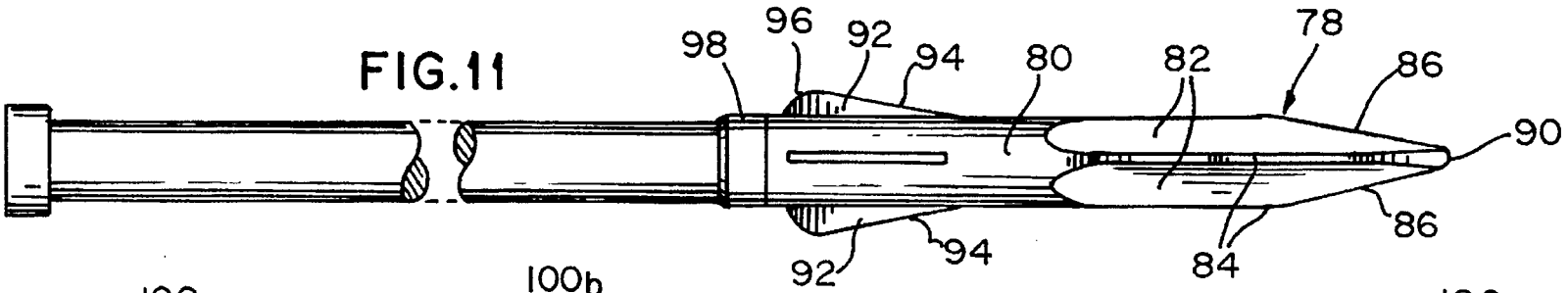
FIG. 11 is similar to FIG. 10, but showing the protector tip mounted on a battering ram useful for initial battering of the barrier without damaging the elongate barrel, the protector tip subsequently being placed on the elongate barrel just prior to penetration.

In FIGS. 10 and 11, a different form of protector tip is illustrated which is specifically designed for penetrating through concrete and brick barriers. The protector tip, generally designated by the reference numeral 78, is shown to have preferably a solid body provided at the forward portion thereof with a plurality of adjacent axial grooves 82 which between them form raised partitions or separating walls 84 between each set of axial grooves. The partition walls 84 are preferably tapered at 86 as shown to form with the elongate axial grooves 82 a barrier piercing point 90. It is also advantageous, on the protector tip 78, to provide a plurality of raised axial fins 92 at the rearward portion of the protector tip 78 for providing means for additionally enlarging the entrance opening in the barrier. The fins 92 are also preferably tapered at 94 to present reduced radial dimensions in the direction towards the barrier piercing point 90. A cylindrical mounting retainer 98 is provided at the rear portion of the protector tip 78 which is provided with a cylindrical cavity for releasably receiving the axial end of the barrel 24, as discussed in connection with the protector tip 28. It is clear that the protector tip 78, partially because of the shape and the greater mass, is more effective in initially chiseling out a small opening and gradually enlarging it by the use of the various partition or separating walls 84 and axial fins 92.

Figure 12:
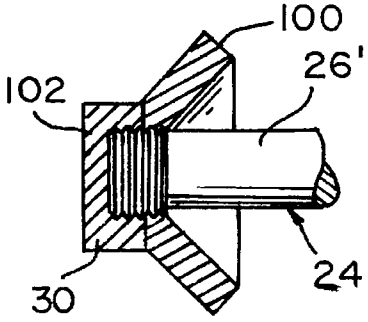
FIGS. 12–15 are fragmented side elevational views, partially in cross section, illustrating different forms of conical protective members at the rear axial ends of the elongate barrels for protecting the fire fighter from potential backdrafts where the entrance opening or openings is slightly bigger than the cross sectional dimensions of the elongate barrel thereby resulting in a small clearance through which gases can pass.
Figure 13:
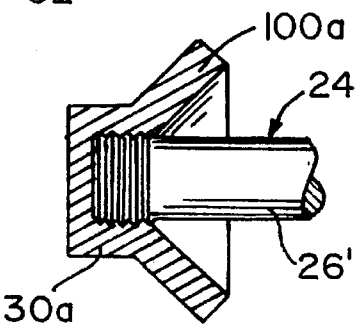
Figure 14:
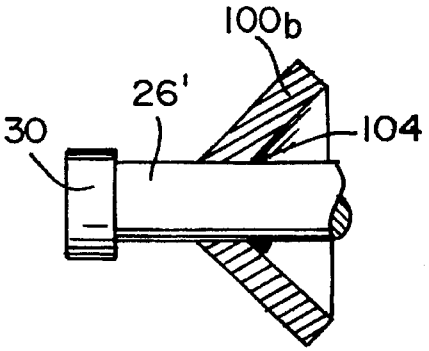
Figure 15:
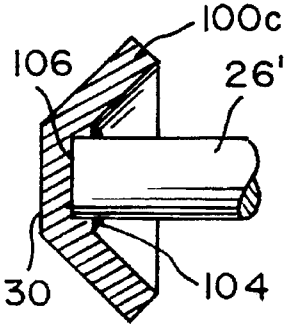

Referring to FIGS. 12–15 there are also illustrated means at the tail end of the barrel 24 for compensating for any clearances created between the barrier entrance opening and the elongate barrel to reduce potential harm to the fire fighter from flames passing through such clearances. In FIG. 12, such further means is in a form of a conical shield 100 which is mounted on the elongate barrel 24 and which tapers outwardly in the forward direction towards the barrier piercing point. The outer radial dimensions of the shield 100 are selected to be greater than the maximum anticipated dimensions of the barrier entrance opening to thereby substantially cover the opening when the barrier is penetrated and the elongate barrel 24 is advanced into the space in which the fire is confined. Although the conical member or shield 100 can be mounted almost anywhere along the longitudinal length of the barrel 24, it is shown in FIG. 12 to be threadadly engaged, together with the end block 30, on a external thread 102 at the rear end of the barrel. In FIG. 13, the conical portion 100*a* is similar as shown in FIG. 12 but shown integrally formed with the end block 30*a*. In FIG. 14, the shield 100*b* is spaced from the hammering block 30 and welded to the barrel 24 by weld 104. FIG. 15 is similar to FIG. 13, except that the block 30 is provided with a cylindrical recess for receiving the end of the barrel instead of being threadably engaged therewith. The combination conical shield and hammering block is welded to the barrel by weld 104.

The penetrating nozzle in accordance with the present invention is capable of being used in varied fire fighting applications and is readily adaptable to punch through standard commercial and residential building materials on its own. This puncture, from the exterior of a structure, room, attic, basement or other enclosed superheated areas allows only the forward portion 26 of the barrel and the nozzle to enter into the area that contains or may contain superheated gases. When the water is turned on, the protector tip of the probe is blown off by hydraulic pressure. This allows the nozzle to form large cone of fire fog spray, convert the spray to steam and reduce the probability of the formation of a backdraft.

When the room is sufficiently cooled, safe entry can be made and the remaining fire put out safely. The penetrating nozzle can then be pulled out of its entry hole, as described, and the protector tip replaced back over the free end of the barrel and re-applied at another location.

By using different accessories, the present invention can be used to convert fog spray to a straight stream for normal sport fire clean-up, as described. The 90° angle adaptor can be screwed onto the tip for the removal of blockages and fire suppression in chimneys and incinerator shafts without the firefighter entering or putting his head in a position of danger.

If the density of the material to be penetrated is beyond the capability of the nozzle alone,the protected tip, which protects the exit opening of the barrel 24 can be driven by any sledge hammer or flat head ax to penetrate concrete block, brick or mild steel, thus opening a clean entry hole for rapidly inserting the penetrating nozzle. This application of the penetrating nozzle through mild steel can be used on steel fire doors, garbage dumpsters, industrial compactors, aircraft fuselages and cargo ships where fires below the decks or in the storage holes are of critical importance.

These features, combined with the penetrating nozzles high delivery flow of super fine fog, straight steam or 90° angled stream makes it an extremely versatile fast attack nozzle for use in fire fighting.

Numerous alterations of the above structures herein discussed will suggest themselves to those skilled in the prior art, however, it is to be understand that the present disclosure relates to preferred embodiments of the invention which are for purposes of illustration only and are not to be construed as limitation of the invention.

I claim:

1. A fire backdraft suppression penetrating nozzle for rapidly providing a relatively small entrance opening in a barrier about an area containing superheated gases for introduction of water into said area, in which said barrier defines a plane and has a predetermined thickness along a direction generally normal to the plane of said barrier; said penetrating nozzle comprising an elongate barrel defining an axis and having a generally uniform cross-section substantially corresponding to the size and shape of the small entrance opening in said barrier to provide little clearance between said elongate barrel and said barrier for passage of gases therebetween when said elongate barrel is received within said entrance opening; said elongate barrel being hollow and forming an elongate passageway having an opening at one axial end of said elongate barrel; water inlet means communicating with said passageway for delivering water under pressure into said passageway; a retrievable protector tip having a cavity shaped and dimensioned to releasably receive said one axial end of said elongate barrel and having a barrier piercing point directed along said axis and being formed of a material suitable for piercing said barrier when said elongate barrel is forced against and into said barrier, said protector tip being separable from said axial end of said elongate barrel once said protector tip has formed an entry hole or opening in said barrier and has penetrated to the other side of said barrier and water under pressure is supplied to said passageway to overcome retaining forces which retain said protector tip on said one axial end; and an elongated, flexible securing means having a substantially constant cross-section along the length thereof and a substantially uniformly smooth exterior surface for securing said protector tip at its barrier piercing point to said elongate barrel so that once said protector tip has been separated from said elongate barrel in said area after having penetrated said barrier and is ejected by said water under pressure, said protector tip being retrievable for another like application upon threading same backwards out through said entrance opening in said barrier; whereby said protector tip is unlikely to be lost and/or damaged by said superheated gases in said area.

2. A nozzle as defined in claim 1, wherein said water inlet means is in fluid flow communication with said passageway at a point intermediate said one axial end of said elongate barrel and another opposing axial end.

3. A nozzle as defined in claim 2, wherein said water inlet means comprises a water inlet conduit which forms an acute angle with said other opposing axial end of said elongate barrel.

4. A nozzle as defined in claim 2, wherein hammering means is provided at said other opposing axial end.

5. A nozzle as defined in claim 4, wherein said hammering means comprises a hammering block arranged along said axis for allowing the nozzle to be hammered along said axis for driving said protector tip through a barrier.

6. A nozzle as defined in claim 1, wherein said flexible securing means comprises a strand of cable connecting said protector tip and said elongate barrel.

7. A nozzle as defined in claim 6, wherein said cable is made of steel rope.

8. A nozzle as defined in claim 1, further comprising water dispensing means for dispensing water exiting said opening at said one axial end after water under pressure is introduced into said passageway and said protector tip is ejected.

9. A nozzle as defined in claim 8, wherein said water dispensing means includes means for dispensing the water along a conical trajectory.

10. A nozzle as defined in claim 9, wherein said dispensing means comprises an auger or spiral shaped screw attachment mounted in the path of water exiting said opening at said one axial end.

11. A nozzle as defined in claim 8, wherein said opening at said axial end has a predetermined area, and said water dispensing means comprises a reduced area nozzle which has an area less than said predetermined area to provide a narrow stream of water.

12. A nozzle as defined in claim 11, wherein said reduced area nozzle opens in a direction substantially parallel to said axis of said elongate barrel.

13. A nozzle as defined in claim 11, wherein said reduced area nozzle opens in a direction at an angle substantially 90° to said axis of said elongate barrel.

14. A nozzle as defined in claim 1, wherein said protector tip has a conical shaped surface which forms said barrier piercing point.

15. A fire backdraft suppression penetrating nozzle for rapidly providing a relatively small entrance opening in a barrier between an enclosed first area containing superheated gases and a second area which is devoid of superheated gases for introduction of water into the first enclosed area, in which the barrier defines a plane and has a predetermined thickness along a direction generally normal to the plane of the barrier, the penetrating nozzle comprising an elongate barrel defining an axis and having a generally uniform cross-section substantially corresponding to the size and shape of the small entrance opening in said barrier to provide little clearance between said elongate barrel and said barrier for passage of gases therebetween when said elongate barrel is received within the entrance opening, said elongate barrel being hollow and forming an elongate passageway having an opening at one axial end of said elongate barrel; water inlet means communicating with said passageway for delivering water under pressure into said passageway; a protector tip having a cavity shaped and dimensioned to releasably receive said one axial end of said elongate barrel and having a barrier piercing point directed along said axis and formed of a material suitable for piercing said barrier when said elongate barrel is battered against said barrier along an axial direction which is substantially normal to the plane of said barrier, said protector tip being separable from said axial end of said elongate barrel once said protector tip has formed an entry hole or opening in said barrier and has penetrated to the other side of said barrier and water under pressure is supplied to said passageway to overcome retaining forces which retain said protector tip on said one axial end; and said protector tip comprising a plurality of raised axial fins at a rearward portion of said protector tip for providing means for additionally enlarging the entrance opening in said barrier, and a generally cylindrical solid body provided at a forward portion with a plurality of adjacent axial grooves to form raised partition walls between each set of adjacent axial grooves, said partition walls being tapered to form with said elongate axial grooves said barrier piercing point.

16. A nozzle as defined in claim 15, where said raised axial fins are tapered and present reduced radial dimensions in the forward direction towards said barrier piercing point.

17. A fire backdraft suppression penetrating nozzle for rapidly providing a relatively small entrance opening in a barrier between an enclosed first area containing superheated gases and a second area which is devoid of superheated gases for introduction of water into the first enclosed area, in which the barrier defines a plane and has a predetermined thickness along a direction generally normal to the plane of the barrier, the penetrating nozzle comprising an elongate barrel defining an axis and having a generally uniform cross-section substantially corresponding to the size and shape of the small entrance opening in said barrier to provide little clearance between said elongate barrel and said barrier for passage of gases therebetween when said elongate barrel is received within the entrance opening, said elongate barrel being hollow and forming an elongate passageway having an opening at one axial end of said elongate barrel; water inlet means communicating with said passageway for delivering water under pressure into said passageway; a protector tip having a cavity shaped and dimensioned to releasably receive said one axial end of said elongate barrel and having a barrier piercing point directed along said axis and formed of a material suitable for piercing said barrier when said elongate barrel is battered against said barrier along an axial direction which is substantially normal to the plane of said barrier, said protector tip being separable from said axial end of said elongate barrel once said protector tip has formed an entry hole or opening in said barrier and has penetrated to the other side of said barrier and water under pressure is supplied to said passageway to overcome retaining forces which retain said protector tip on said one axial end; and said elongate barrel having further means at the other axial end of said elongate barrel for compensating for any clearances created between said barrier entrance opening and said elongate barrel to reduce potential harm to the fire fighter from flames and/or superheated gases passing through said clearance.

18. A nozzle as defined in claim 17, wherein said further means comprises a conical shield on said elongate barrel which tapers outwardly at the forward direction towards said barrier piercing point, said outer dimensions of said shield being greater than the maximum anticipated dimensions of the barrier entrance opening to thereby substantially cover said opening when the barrier is penetrated and said elongate barrel is advanced forwardly into said first area.

* * * * *